US010651538B1

(12) United States Patent
Schwartz

(10) Patent No.: US 10,651,538 B1
(45) Date of Patent: May 12, 2020

(54) METHOD FOR RETRACTABLY SHROUDING ANTENNA CABLES

(71) Applicant: Chad Schwartz, Annandale, NJ (US)

(72) Inventor: Chad Schwartz, Annandale, NJ (US)

(73) Assignee: CCS Technologies LLC, Annandale, NJ (US)

( * ) Notice: Subject to any disclaimer, the term of this patent is extended or adjusted under 35 U.S.C. 154(b) by 44 days.

(21) Appl. No.: 16/224,078

(22) Filed: Dec. 18, 2018

(51) Int. Cl.

| | |
|---|---|
| ***H01Q 1/14*** | (2006.01) |
| ***H01Q 1/42*** | (2006.01) |
| ***H01Q 1/50*** | (2006.01) |
| ***H01Q 1/12*** | (2006.01) |

(52) U.S. Cl.
CPC ..... *H01Q 1/14* (2013.01); *H01Q 1/1242* (2013.01); *H01Q 1/42* (2013.01); *H01Q 1/50* (2013.01)

(58) Field of Classification Search
CPC .. H01Q 1/14; H01Q 1/42; H01Q 1/50; H01Q 1/1242; E04H 12/003
See application file for complete search history.

(56) References Cited

U.S. PATENT DOCUMENTS

| | | | | |
|---|---|---|---|---|
| 4,217,464 | A | 8/1980 | Oldham | |
| 5,486,120 | A | 1/1996 | McMills et al. | |
| 6,394,842 | B1 | 5/2002 | Sakurai et al. | |
| 6,969,279 | B1 | 11/2005 | Mahoney | |
| 8,063,304 | B2 | 11/2011 | Martell et al. | |
| 2004/0080461 | A1 | 4/2004 | Rothgeb et al. | |
| 2004/0188130 | A1 | 9/2004 | Herrera | |
| 2009/0325421 | A1 | 12/2009 | Gills et al. | |
| 2017/0238432 | A1* | 8/2017 | Lapham | H04W 88/08 362/225 |
| 2017/0279187 | A1* | 9/2017 | Lockwood | E04H 12/12 |

* cited by examiner

*Primary Examiner* — Robert Karacsony
(74) *Attorney, Agent, or Firm* — Thomas J. Germinario

(57) ABSTRACT

A method is disclosed for alternately covering and exposing feed cables to a wireless telecommunications antenna from a pole-mounted RF source. The method deploys a resiliently stretchable tubular shroud, which has a proximal opening attached near the top of the pole and a distal opening alternately attachable to a section of the antenna proximate to the cable connections or to a section of the pole below the proximal shroud opening. In the former configuration, the shroud covers and protects the feed cables, while in the latter configuration, the retracted shroud exposes the cables for repair, maintenance, replacement and/or inspection operations.

10 Claims, 5 Drawing Sheets

METHOD FOR RETRACTABLY SHROUDING ANTENNA CABLES

FIELD OF INVENTION

The present invention relates to the general field of telecommunications antennas, and more specifically to methods of protecting exposed feed cables running from a radio frequency (RF) source in or on a pole to a supported wireless telecommunication antenna.

BACKGROUND OF THE INVENTION

Small cell sites or "nodes" are often deployed to increase the capacity of wireless telecommunications networks. Small cell antennas are typically mounted on existing utility pole and street light stanchions, which support or enclose one or more wireless telecommunication RF sources. Feed cables from the RF sources to the antenna are exposed where the antenna connects to the pole, leaving them vulnerable to the elements and vandalism. Therefore, it is advantageous to enclose the RF feed cables in a protective cover or shroud. In certain situations, it is also desirable to conceal the feed cables for aesthetic reasons.

The conventional approach to covering the RF feed lines to an antenna has been to install a rigid frusto-conical shroud, often using a two-piece clamshell structure. But such rigid shrouds must be mechanically removed when the antenna or feed lines are accessed for repair and maintenance. The present invention, on the other hand, is a method by which the antenna connections and the RF feed cables can be shrouded without requiring the cable shroud to be removed from the pole for maintenance/repair access.

SUMMARY OF THE INVENTION

The present invention is a method for retractably shrouding feed cables connecting a radio frequency (RF) source to a pole-mounted antenna. The shroud has a generally tubular shape with a proximal opening and a distal opening. The shroud is made of a resiliently stretchable material, such as neoprene or stretch vinyl.

The proximal shroud opening is attached around a terminal pole section near the top of the pole where the feed cables extend toward the antenna. The shroud is then stretched toward the antenna and the distal opening is removably attached around a feed section of the antenna to which the feed cables are connected. When access to the feed cables is required for repair, maintenance or inspection purposes, the shroud's distal opening is detached from the feed section of the antenna and the shroud is stretched back and retracted away from the antenna so as to expose the feed cables. After retraction, the distal opening of the shroud is attached to a medial section below the terminal section of the pole. When cable access activities are completed, the distal opening is detached from the medial section of the pole and reattached to the feel section of the antenna, so that the feed cables are again protected.

The proximal and distal openings of the shroud can be elastically expandable so as to be attached and detached by alternately expanding or releasing the elastic opening. Alternatively, one or both of the shroud openings can be attached by an annular clamp.

The inventive method simplifies and speeds the task of exposing the feed cables for replacement, repair, maintenance and/or inspection, since the shroud need not be mechanically removed during such operations and then replaced upon their completion.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
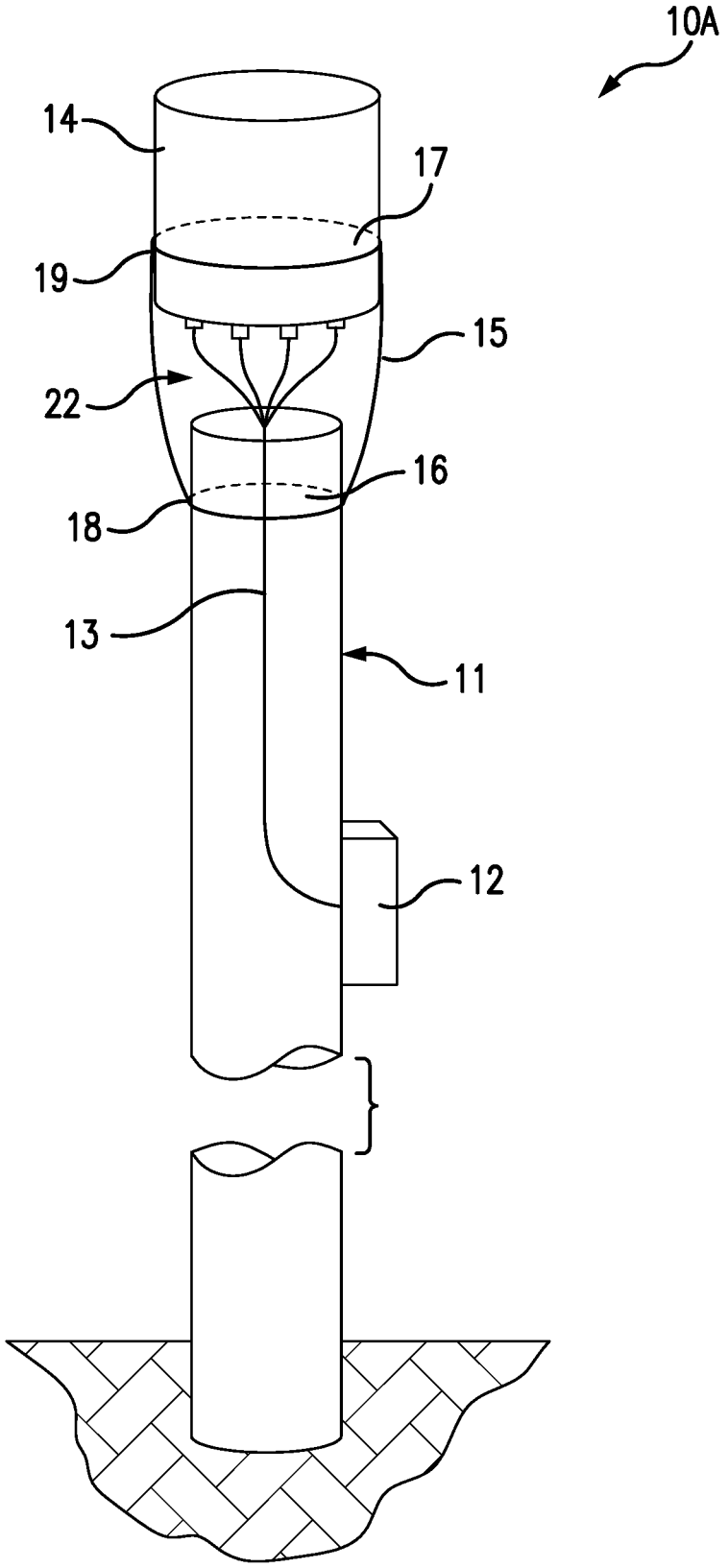
FIG. 1 is a perspective view of the shroud raised to cover the feed cables connecting an RF source to a pole-mounted antenna, according to the first embodiment of the present invention.
Figure 2:
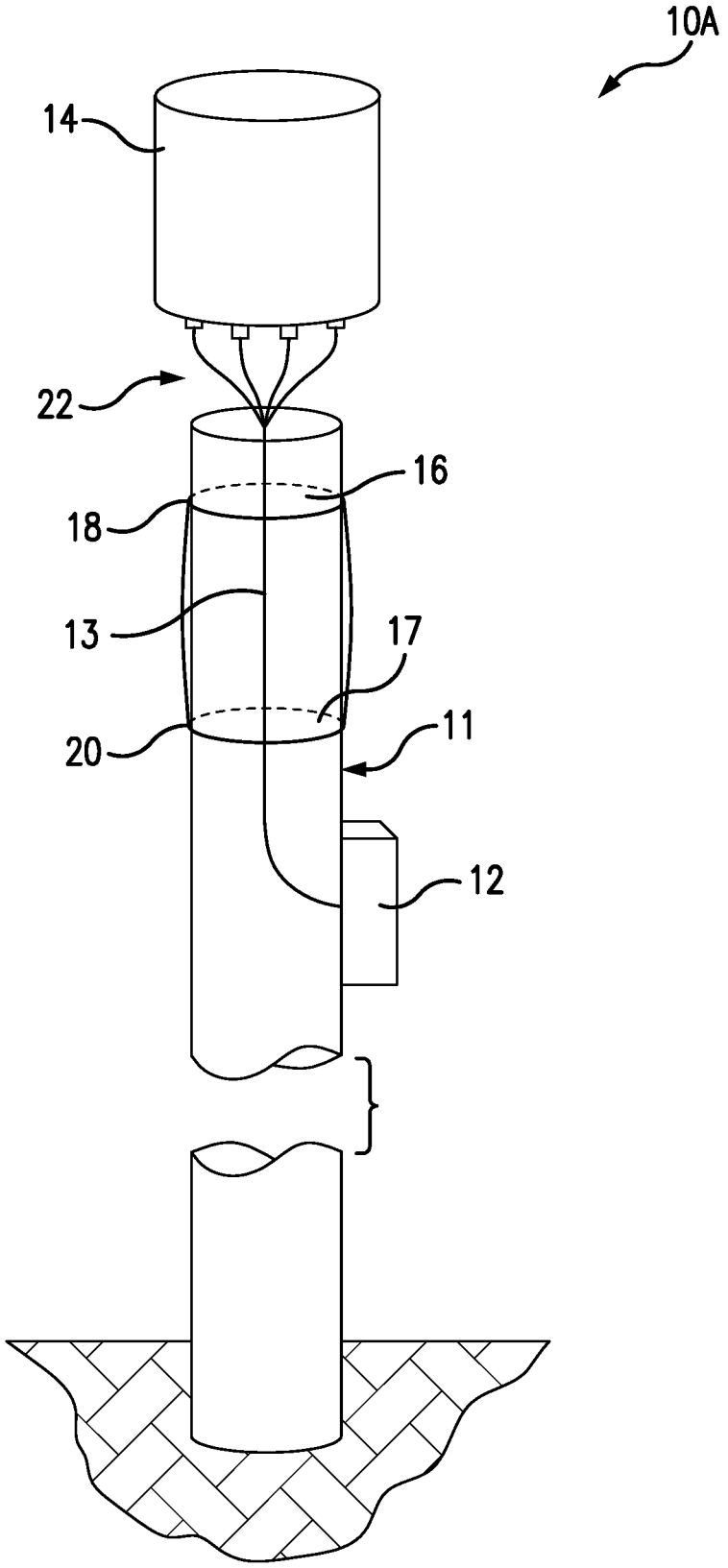
FIG. 2 is a perspective view of the shroud retracted from the antenna to expose the feed cables for access-requiring operations, according to the first embodiment of the present invention.

Referring to FIGS. 1 and 2, in the first embodiment of the present invention 10A, the inventive method is applied to a pole 11 that encloses or supports an RF source 12, from which feed cables 13 extend to a pole-mounted antenna 14. In FIG. 1, the tubular shroud 15 is shown raised to cover and protect the feed cables 13. The shroud 15 has a proximal opening 16 and a distal opening 17. In the covering configuration, the proximal opening 16 is attached to the pole's terminal section 18 proximate to the cable connections 22, while the distal opening 17 is attached to the antenna's feed section 19 proximate to the cable connections 22.

In FIG. 2 the shroud 15 is shown retracted to expose the feed cables 13 and permit access to them for repair, maintenance, replacement and/or inspection operations. After retracting the shroud 15, the distal opening 17 is attached to a medial section 20 of the pole 11 below the terminal pole section 18. Once the access operations are completed, the distal opening 17 is detached from medial pole section 20 and reattached to the antenna's feed section 19 so as to again cover and protect the feed cables 13.

Figure 3:
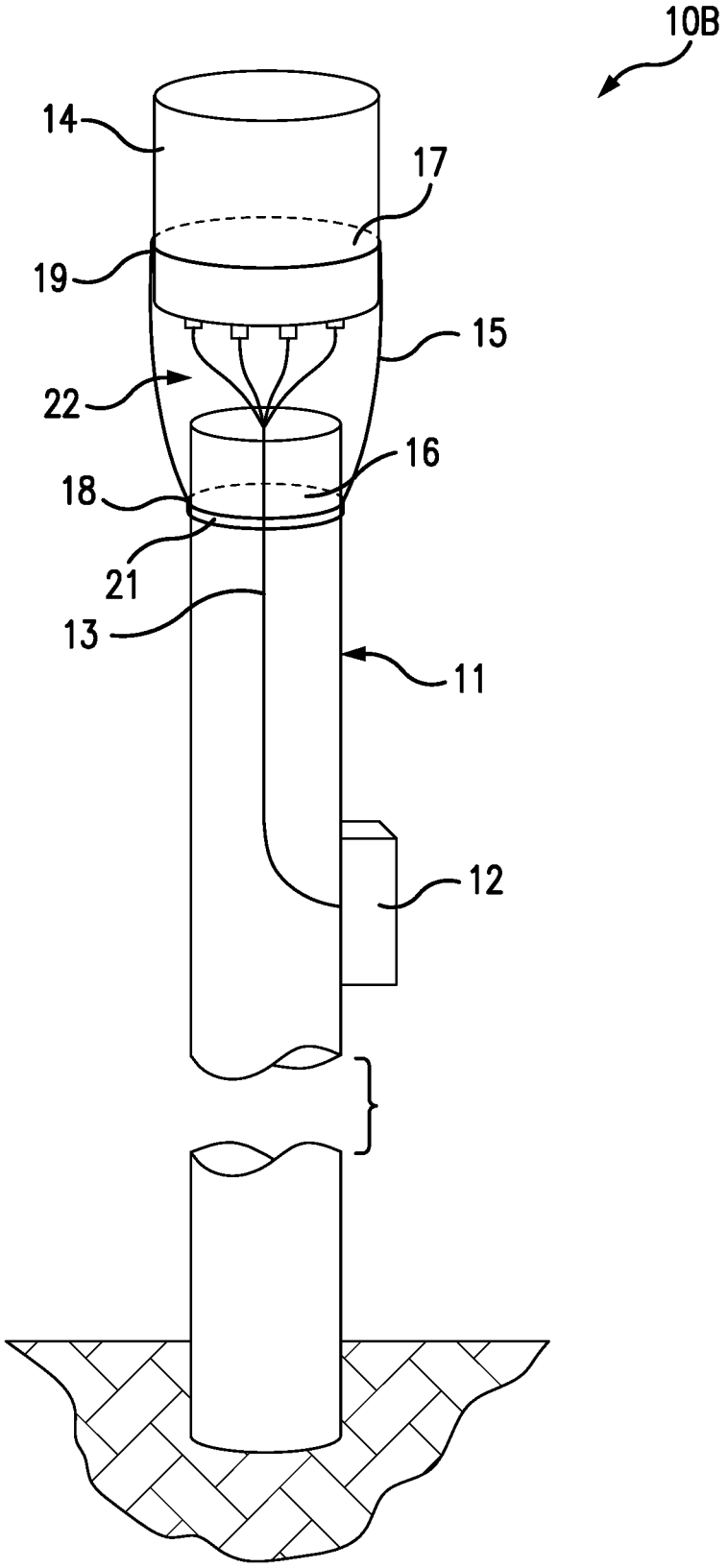
FIG. 3 is a perspective view of the shroud raised to cover the feed cables connecting an RF source to a pole-mounted antenna, according to the second embodiment of the present invention.
Figure 4:
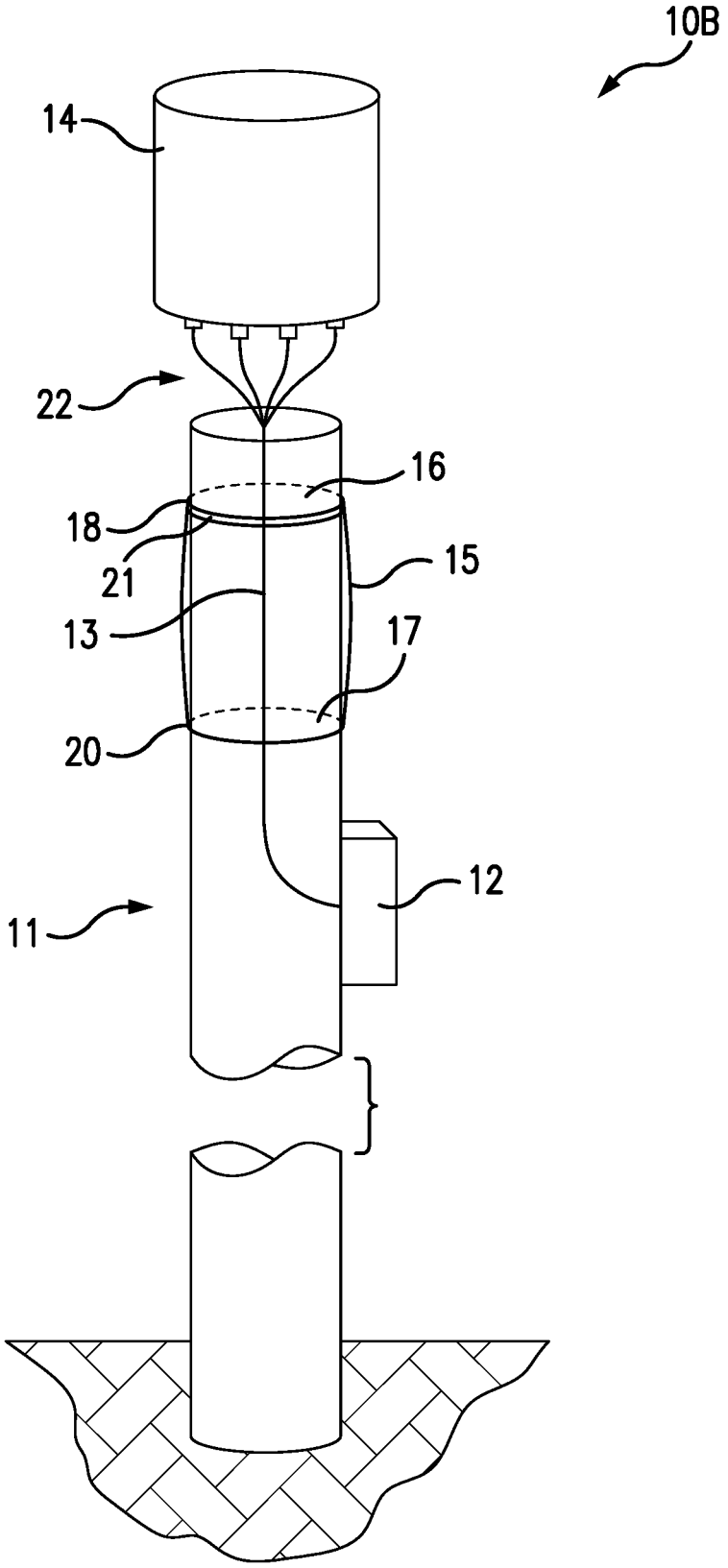
FIG. 4 is a perspective view of the shroud retracted from the antenna to expose the feed cables for access-requiring operations, according to the second embodiment of the present invention.

In the first embodiment 10A depicted in FIGS. 1 and 2, both shroud openings 16 17 are elastically expandable, so as to be attached and detached by alternately expanding and releasing the shroud openings 16 17. In the second embodiment 10B, depicted in FIGS. 3 and 4, the proximal opening 16 is attached to the pole's terminal section 18 by an annular clamp 21, which is similar to a hose clamp. It is understood that either of both shroud openings can be attachable by either the elastic or the clamp means.

Figure 5:
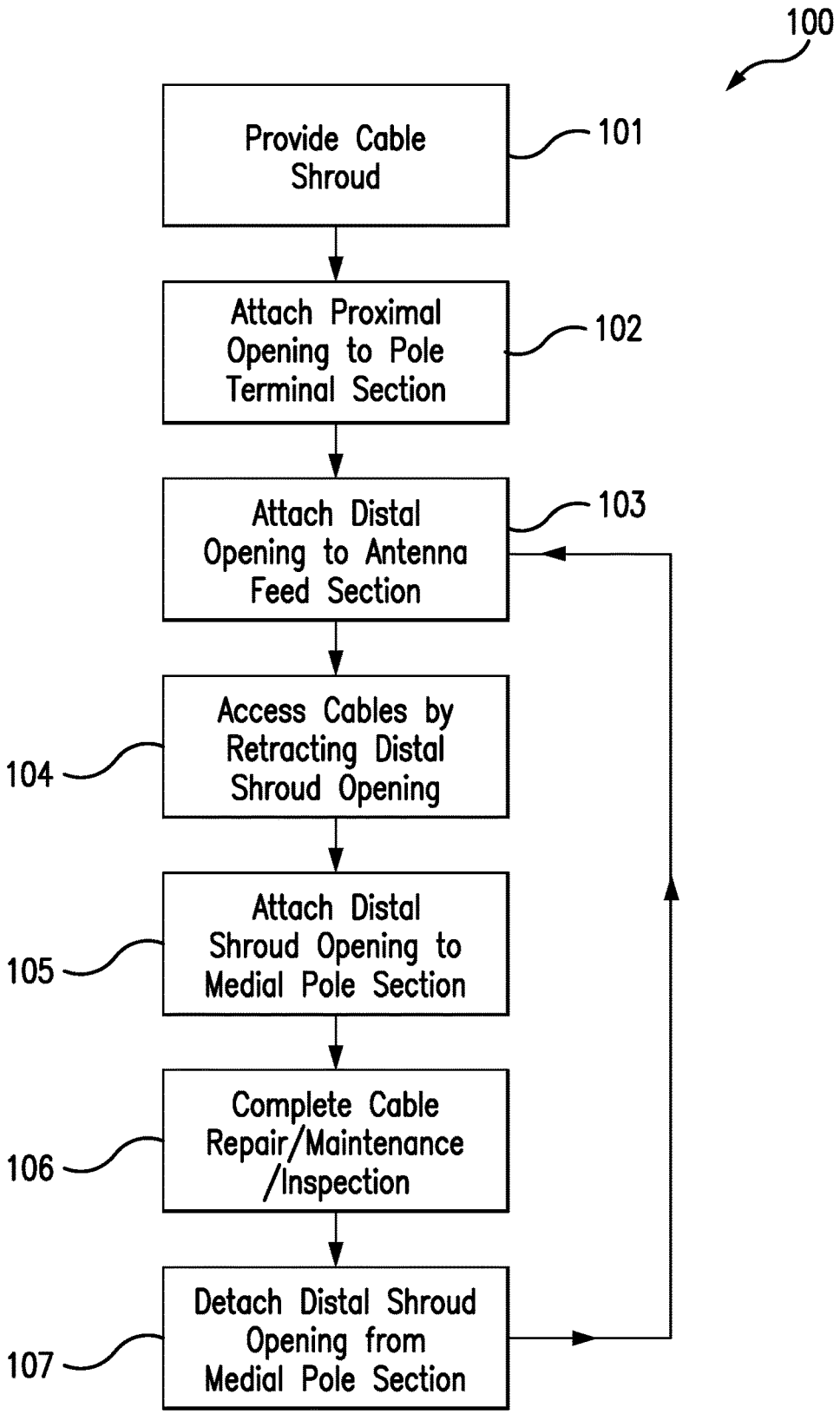
FIG. 5 is a flow chart of the method according to both embodiments of the present invention.

FIG. 5 displays the exemplary method of the present invention 100 in flowchart format. The shroud is provided 101, its proximal opening is attached to the pole's terminal section 102, and its distal opening is attached to the antenna's feed section 103. To access the feed cables, the distal shroud opening is retracted 104 and attached to the medial pole section 105. Upon completion of access operations 106, the distal opening is detached from the medial pole section 107 and is reattached to the antenna feed section 103, so as to again cover and protect the feed cables.

Although the preferred embodiments of the present invention have been disclosed for illustrative purposes, those skilled in the art will appreciate that many additions, modifications and substitutions are possible, without departing from the scope and spirit of the present invention as defined by the accompanying claims.

What is claimed is:

1. A method for retractably shrouding feed cables connecting a radio frequency (RF) source to an antenna mounted on a pole, the method comprising the following steps:

(a) Providing a cable shroud having a generally tubular shape and having a proximal opening and a distal opening, wherein the cable shroud is made of a resiliently stretchable material;

(b) Attaching the proximal opening of the cable shroud around a terminal section of the pole from which the feed cables extend;

(c) Stretching and removably attaching the distal opening of the cable shroud around a feed section of the antenna into which the feed cables are connected; and (d) When access to the feed cables is required, stretching and detaching the distal opening of the cable shroud from around the feed section of the antenna and retracting the distal opening of the cable shroud away from the feed section of the antenna so that the feed cables are exposed.

2. The method according to claim 1, comprising the following additional steps:

(e) Removably attaching the distal opening of the cable shroud around a medial section of the pole, wherein the terminal section of the pole is between the medial section of the pole and the feed section of the antenna; and (f) When access to the feed cables is completed, stretching and detaching the distal opening from around the medial section of the pole; and (g) Repeating step (c).

3. The method according to claim 2, wherein in step (a) the proximal opening of the cable shroud is elastically expandable, and wherein in step (b) the proximal opening of the cable shroud is elastically expanded around the terminal section of the pole and then released to elastically constrict so as to removably attach around the terminal section of the pole.

4. The method according to claim 2, wherein in step (a) the distal opening of the cable shroud is elastically expandable, and wherein in step (c) the distal opening of the cable shroud is elastically expanded around the feed section of the antenna and then is released so as to removably attach the distal opening of the cable shroud around the feed section of the antenna.

5. The method according to claim 3, wherein in step (a) the distal opening of the cable shroud is elastically expandable, and wherein in step (c) the distal opening of the cable shroud is elastically expanded around the feed section of the antenna and then is released so as to removably attach the distal opening of the cable shroud around the feed section of the antenna.

6. The method according to claim 4, wherein in step (b) the proximal opening of the cable shroud is removably attached around the terminal section of the pole by a first annular clamp.

7. The method according to claim 3, wherein in step (c) the distal opening of the cable shroud is removably attached around the feed section of the antenna by a second annular clamp.

8. The method according to claim 2, wherein in step (b) the proximal opening of the cable shroud is removably attached around the terminal section of the pole by a first annular clamp, and wherein in step (c) the distal opening of the cable shroud is removably attached around the feed section of the antenna by a second annular clamp.

9. The method according to any one of claims 4-6, wherein in step (e) the distal opening of the cable shroud is elastically expanded around the medial section of the pole and then is released so as to removably attach the distal opening of the cable shroud around the medial section of the pole.

10. The method according to either of claim 7 or 8, wherein in step (e) the distal opening of the cable shroud is removably attached around the medial section of the pole by a third annular clamp.

* * * * *